United States Patent [19]

Garriott

[11] 3,982,337

[45] Sept. 28, 1976

[54] SNOW MOVING APPARATUS

[76] Inventor: Eugene L. Garriott, 614 E. Gordon, Marshall, Mo. 64340

[22] Filed: Sept. 19, 1975

[21] Appl. No.: 559,896

[52] U.S. Cl. ..... 37/43 L; 37/42 VL

[51] Int. Cl.[2] ..... E01H 5/09; E01H 5/02

[58] Field of Search ..... 37/43 L, 42 VL, 50, 37/43 K; 56/17.5, 295; 15/79 A

[56] References Cited

UNITED STATES PATENTS

| | | | |
|---|---|---|---|
| 520,479 | 5/1894 | Bunnell | 37/42 VL X |
| 2,576,884 | 11/1951 | Leigh | 56/295 |
| 2,969,634 | 1/1961 | Lannert | 37/43 L |
| 2,984,919 | 5/1961 | Stoddard | 37/43 L X |
| 2,991,567 | 7/1961 | Erickson | 37/43 L |
| 3,015,929 | 1/1962 | Bright | 37/43 L |
| 3,061,480 | 10/1962 | Zink et al. | 37/43 L X |
| 3,103,678 | 9/1963 | Smith | 37/43 L X |
| 3,399,519 | 9/1968 | Buchanan | 56/295 |
| 3,514,935 | 6/1970 | Bonsor | 56/295 |
| 3,753,341 | 8/1973 | Berg, Jr. et al. | 56/295 X |
| 3,775,878 | 12/1973 | Beckner | 37/43 L |

*Primary Examiner*—Edgar S. Burr
*Assistant Examiner*—Steven A. Bratlie
*Attorney, Agent, or Firm*—Fishburn, Gold & Litman

[57] ABSTRACT

A snow moving apparatus for clearing drives, walks, patios, and the like includes a mobile downwardly open housing rotatably supporting therein a drive shaft having an elongated rotor or support member mounted on a lower end portion thereof and a pair of snow impeller members each mounted on a respective opposite end portion of the support member and having a shape adapted to move snow outwardly through a discharge opening in the housing upon rotation of the drive shaft, such a snow moving apparatus being the support member and impeller member on the power shaft of a rotary lawn mower.

1 Claim, 5 Drawing Figures

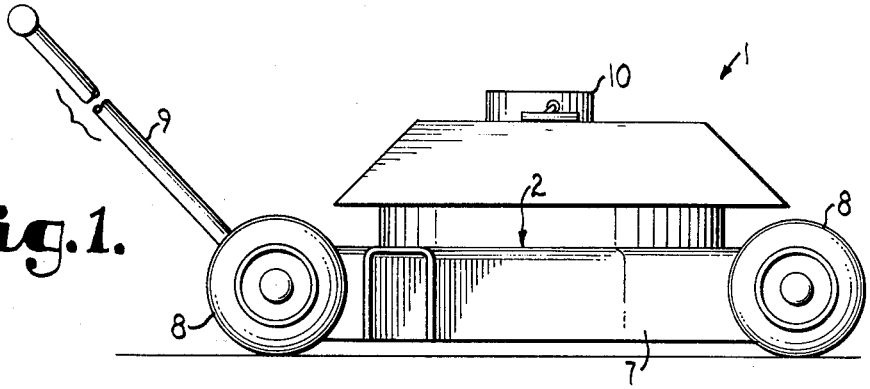
Fig. 1.
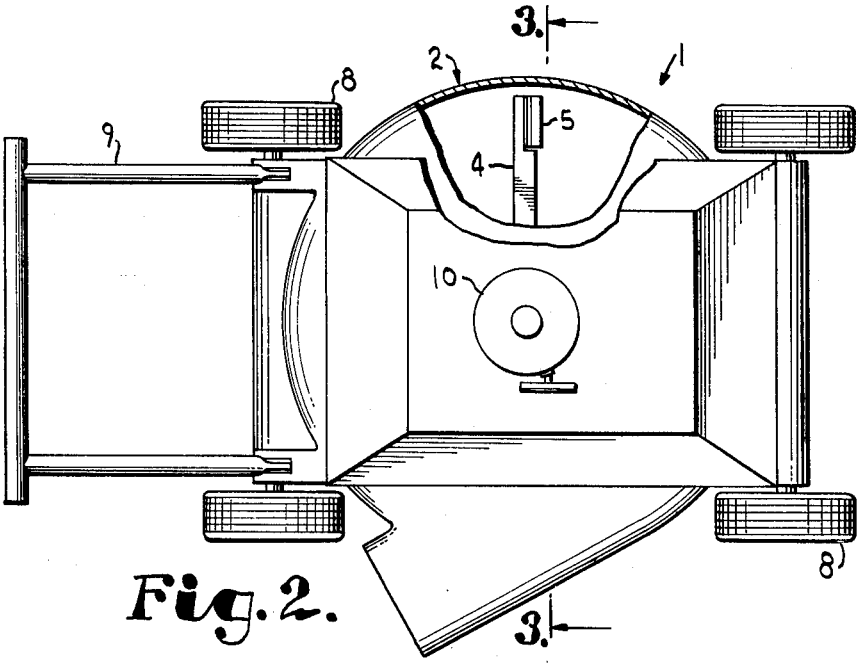
Fig. 2.
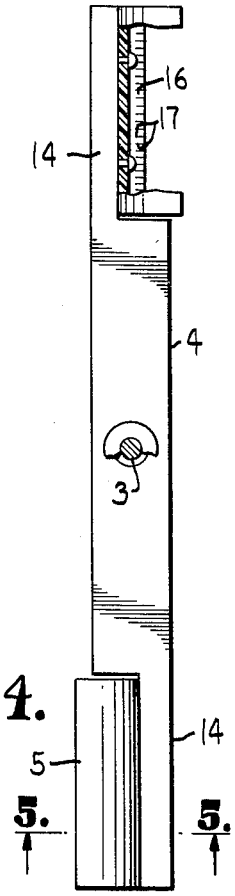
Fig. 4.
Fig. 5.
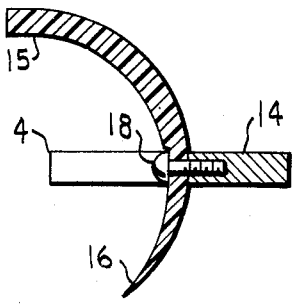
Fig. 3.
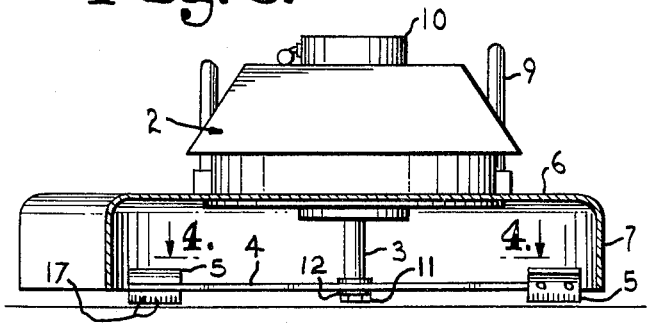

SNOW MOVING APPARATUS

The present invention relates to snow moving apparatus and more particularly to such an apparatus having snow impeller members on opposite ends of a rotatably mounted support member.

The principal objects of the present invention are: to provide a power driven snow moving apparatus for clearing drives, walks, patios, and the like; to provide such a snow moving apparatus having impeller members on opposite ends of a rotatably mounted rotor support member with the impeller members being shaped to move snow outwardly through a discharge opening in a housing of the apparatus; to provide such a snow moving apparatus wherein the impeller members are arcuate in transverse cross section; to provide such a snow moving apparatus wherein the impeller members each have an upper edge portion thereof having greater thickness than a lower edge portion whereby the lower edge portion is flexible; to provide such an impeller member having a plurality of longitudinally spaced slots in the lower edge portion thereof to define flexible teeth; to provide such a rotor or support and impeller members for use on the power shaft of a rotary lawn mower; to provide such an impeller member formed of plastic material which has sufficient flexiblity to avoid propelling large objects; and to provide such a snow moving apparatus and impeller members therefor which is economical to manufacture, durable in construction, position in operation, and particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and includes an exemplary embodiment of the present invention and illustrate various objects and features of the snow moving apparatus and plow members therefor.

FIG. 1 is a side elevational view of a snow moving apparatus embodying features of the present invention.

FIG. 2 is a top plan view of the snow moving apparatus.

FIG. 3 is an enlarged transverse sectional view through a housing of the snow moving apparatus.

FIG. 4 is an enlarged fragmentary sectional view taken on line 4—4 of FIG. 3 and showing plow members in plan view.

FIG. 5 is an enlarged fragmentary sectional view through one of the plow members.

As required, detailed embodiments of the present invention are disclosed herein, however, it is to be understood that the disclosed embodiments are merely exemplary of the invention which may be embodied in various forms, therefore, specific and functional details disclosed herein are not to be interpreted as limiting but merely as a basis for the claims and as a representative basis for teaching one skilled in the art to variously employ the present invention in virtually any appropriately detailed structure.

Referring more in detail to the drawings

In the disclosed embodiment of the present invention the reference numeral 1 designates generally a snow moving apparatus for clearing drives, walks, patios, and the like. The snow moving apparatus 1 includes a mobile downwardly open housing 2 rotatably supporting therein a substantially vertical drive shaft 3 having an elongated rotor or support member or bar 4 mounted on a lower end portion thereof in a manner for rotation in a substantially horizontal plane. A pair of snow impeller members or blades 5 are each mounted on a respective one of the opposite end portions of the support member 4 and each have a shape adapted to move snow outwardly through a discharge opening in the housing 2 upon rotation of the drive shaft 3.

The housing 2 may be any desired shape, such as a rotary lawn mower housing adapted to travel over a surface during removal of snow therefrom. In the illustrated structure, the housing 2 has a top wall 6 and a side wall 7 depending therefrom. The housing 2 is illustrated as being generally circular in plan view with a discharge opening in the side wall 7 and having a suitable chute extending tangentially from the side wall 7.

Any suitable means may be provided to support the snow moving apparatus 1 during movement thereof over a surface during snow removal. In the illustrated structure, suitable axles are mounted on the side wall 7 and each are adapted to rotatably support respective wheels 8 providing a mobile housing 2.

A suitable handle 9 is connected to the housing 2 permitting same to be maneuvered as desired during travel over drives, walks, patios, and the like during snow removal therefrom.

A suitable drive motor 10 is mounted on the top wall 6 of the housing 2 and is operatively connected to the drive shaft 3 to rotate same. The drive shaft 3 is substantially vertical and depends from the top wall 6 and is centered within the housing 2.

The elongated rotor or support member 4 shown is a bar like member removably mounted on a lower end portion of the drive shaft 3, as by a nut 11 and a lock washer 12. The support member 4 is similar to a rotary lawn mower blade and is generally planar and has extensions or ears 14 of lesser width than the bar 4 and extending longitudinally outwardly from respective opposite ends thereof. In the illustrated structure, the ears 14 extend from adjacent a trailing edge of the respective end portion of the plow support member 4.

The impeller members or blades 5 are preferably formed of suitable plastic and each are arcuate in transverse cross section and have an upper edge portion 15 and a lower edge portion 16 respectively extending above and below the support bar 4. The upper edge portion 15 is thick and curves upwardly and forwardly from the support bar and terminates in an end substantially parallel with the support bar. The lower edge portion 16 curves downwardly and forwardly from the support bar 4 and has decreasing thickness terminating in a thin lower edge. The lower edge portion 16 has a plurality of longitudinally spaced slots 17 extending upwardly from the lower edge to define a plurality of flexible teeth each adapted to flex or bend upon impact with large objects thereby avoiding projecting same through the chute of the housing 2. The impeller members are mounted on the respective ears 14, as by a plurality of screws 18.

The housing preferably has a depending flexible shield (not shown) fixed to and depending from the housing 2 at the rear portion thereof to protect the operator from any material moving outwardly under the rear portion of the housing 2.

In using a snow moving apparatus as illustrated and described, the housing 2 is maneuvered over the surface to be cleared by means of the handle 9 and the wheels 8 or suitable runners (not shown). The drive motor 10 is operative to rotate the drive shaft 3 and the plow support member or bar 4 mounted thereon. The plow or impeller members 5 move in a circular path around the drive shaft 3 with the lower edge portion 16 thereof preferably positioned just slightly above the surface being cleared. Centrifugal force and the cooperative curvature of the impellers are effective to move the collected snow outwardly through the chute of the housing 2.

It is to be understood that while I have illustrated and described one form of my invention, it is not to be limited to the specific form or arrangement of parts herein described and shown.

What I claim and desire to secure by Letters Patent is:

1. A snow moving apparatus comprising:

a. a housing having a top wal and a side wall depending therefrom, said side wall having a discharge opening therein;

b. means mounted on said housing to permit movement thereof along a selected path;

c. a substantially vertical drive shaft depending from said top wall of said housing and means operatively connected thereto for selectively rotating same;

d. an elongated support bar mounted on said drive shaft and extending normal thereto for rotation on a substantially horizontal plane, said support bar having opposite end portions; and e. a pair of unitary detachable plastic concavely curved impeller members each mounted on and along the edge of a respective opposite end portion of said support bar and generally coextensive therewith and having a lower flexible portion curved downwardly and forwardly from the support bar and of decreasing thickness terminating in a thin lower edge, said lower flexible portion having a plurality of longitudinally spaced slots extending upwardly therein from said lower edge to define a plurality of flexible teeth, f. said impeller members each having an upper portion curved upwardly and forwardly and of greater thickness than the depending portion of said lower flexible portion from said support bar and terminating in an end substantially parallel to said support bar, said curved portions cooperating to move snow laterally outwardly through the discharge opening in said housing side wall upon rotation of said drive shaft.

* * * * *